United States Patent [19]

Costilow et al.

[11] Patent Number: 4,813,666

[45] Date of Patent: Mar. 21, 1989

[54] LEG ANTERIOR MUSCLE EXERCISER

[76] Inventors: Warren M. Costilow, P.O. Box 293, N. Carrollton, Miss. 38947; Roger L. Fletcher, Rt. 1, Box 540, Greenwood, Miss. 38930

[21] Appl. No.: 121,891

[22] Filed: Nov. 17, 1987

[51] Int. Cl.[4] ..... A63B 23/04

[52] U.S. Cl. ..... 272/96; 272/117

[58] Field of Search ..... 272/96, 117, 118, 123, 272/134, 144, 145; 128/25 B

[56] References Cited

U.S. PATENT DOCUMENTS

| | | | |
|---|---|---|---|
| 2,542,074 | 2/1951 | Bierman . | |
| 3,020,046 | 2/1962 | Hotas . | |
| 3,414,261 | 12/1968 | Huebner | 272/117 |
| 3,525,522 | 8/1970 | Piller . | |
| 3,850,430 | 11/1974 | Hamilton | 272/117 |
| 3,863,916 | 2/1975 | Cline | 272/117 X |
| 4,199,137 | 4/1980 | Giguere | 272/96 |
| 4,266,766 | 5/1981 | Calderone | 272/134 X |
| 4,270,749 | 6/1981 | Hebern | 272/96 |
| 4,337,939 | 7/1982 | Hoyle et al. | 272/117 X |
| 4,509,746 | 4/1985 | Mask | 272/117 X |
| 4,572,505 | 2/1986 | Kornhaus | 272/117 X |
| 4,577,861 | 3/1986 | Bangerter | 272/96 |
| 4,605,220 | 8/1986 | Troxel | 272/96 |
| 4,650,183 | 3/1987 | McIntyre | 272/96 |
| 4,727,860 | 3/1988 | McIntyre | 272/96 |
| 4,733,859 | 3/1988 | Kock et al. | 272/96 |

FOREIGN PATENT DOCUMENTS

| | | | |
|---|---|---|---|
| 523879 | 4/1956 | Canada | 272/144 |
| 642552 | 4/1984 | Switzerland | 272/96 |

*Primary Examiner*—Richard J. Apley
*Assistant Examiner*—Robert W. Bahr
*Attorney, Agent, or Firm*—Fleit, Jacobson, Cohn & Price

[57] ABSTRACT

An exerciser is provided for exercising the leg anterior muscles of a person and includes a forwardly facing seat upon which the person may be seated. A weight arm includes an upper rear end portion mounted for oscillation about a horizontal transverse axis which may be adjusted in elevation relative to the seat and the weight arm rear upper end portion includes a first upwardly facing abutment surface for engagement by the underside of the heel portions of the exerciser as well as a second downwardly facing abutment surface for engagement by the upper forward portions of the exerciser's feet. The forward end of the weight arm includes structure for supporting a variable amount of weight therefrom and the axis of oscillation of the weight arm is disposed closely adjacent the first upwardly facing abutment surface.

4 Claims, 2 Drawing Sheets

LEG ANTERIOR MUSCLE EXERCISER

BACKGROUND OF THE INVENTION

Field of the Invention

An exercise device is provided to be used by a person while seated in position with his or her upper and lower leg portions generally horizontally and vertically disposed, respectively. The exerciser includes upwardly facing surface structure adapted to be engaged by the rear heel sole portions of the user when disposed in the aforementioned seated position and additional downwardly facing abutment surface structure spaced horizontally forward of the upwardly facing abutment surface structure and beneath which the upper forward portions of the user's feet may be engaged. The upwardly and downwardly facing support structures are mounted from a pivoted base end portion of a lever arm whose free end projects forwardly from the base end portion and the free end portion of the lever arm may have various weight value weight members removably supported therefrom. The user of the exerciser may then exercise the anterior muscles of his or her legs by elevating the forward portions of the feet in order to upwardly displace the downwardly facing abutment surface structure relative to the upwardly facing abutment surface structure and thus cause the free forward end of the lever arm to swing upwardly.

The anterior and lateral musculature of the leg are long thin muscles with the major portions of the muscle bellies being in the proximal half of the leg. The tendons from the two groups pass down to either side of the foot forming an arch to support the tarso-metatarsal articulation as well as to invert, evert and dorsiflex the foot at the ankle.

The anterior muscle of the leg consists of four muscles—the tibialis anterior, extensor digitorum longus, peroneus tertuis and extensor hallucis longus.

All the muscles of this group flex the foot, that is, they lift the foot at the ankle and bring the toes closer to the front of the leg. The extensors extend the toes, the peroneus tertius and the extensor digitorum longus evert the foot. The nerve supply to this group of muscles is from the deep peroneal (anterior tibial) nerve.

The lateral muscles consist of the peroneus longus and the peroneus brevis. They extend (plantaiflex) and evert the foot. The peroneus longus and the tibialis anterior form a sterrup for the support of the transverse and longitudinal arches of the foot.

The purpose and overall function of the two groups is to lift the front of the foot so that in walking or running the toes do not drag as the foot is brought forward. Paralysis of these results in a foot drop and the person has to walk with a "slapping gait".

The anterior group of muscles are in a relative fixed or closed space and sudden working in this area produces what is called the anterior compartment syndrome with nerve pain.

To avoid such problems, exercise of these groups should be performed at a pace to allow expansion of the fibrous membrane about the group.

DESCRIPTION OF RELATED ART

Various different forms of ankle exercisers and other types of exercisers including some of the general structural and operational features of the instant invention are disclosed in U.S. Pat. Nos. 2,542,074, 3,020,046, 3,525,522, 4,199,137, 4,270,749, 4,337,939, 4,577,861 and 4,605,220.

However, these previously known forms of exercisers do not include the overall combination of structural features of the instant invention which particularly well adapt the latter to be conveniently utilized not only for maximum anterior leg muscle development but also for physical therapy purposes.

The main object of this invention is to provide an anterior leg exercising apparatus which is constructed in a manner to be conveniently utilized for both maximum anterior leg muscle development and for physical therapy purposes.

Another object of this invention is to provide an anterior leg muscle exerciser in accordance with the preceding object and constructed in a manner to enable ready adjustment of resistance weight thereof.

Yet another object of this invention is to provide an exerciser which may be readily adjusted to different size persons.

Still another object of this invention is to provide a leg anterior muscle exerciser in accordance with the preceding objects and which also may be readily adjusted according to differences in foot size.

Still another object of this invention is to provide a leg anterior muscle exerciser which also may be effectively used for upper leg muscle development.

A final object of this invention to be specifically enumerated herein is to provide an anterior leg muscle exerciser in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
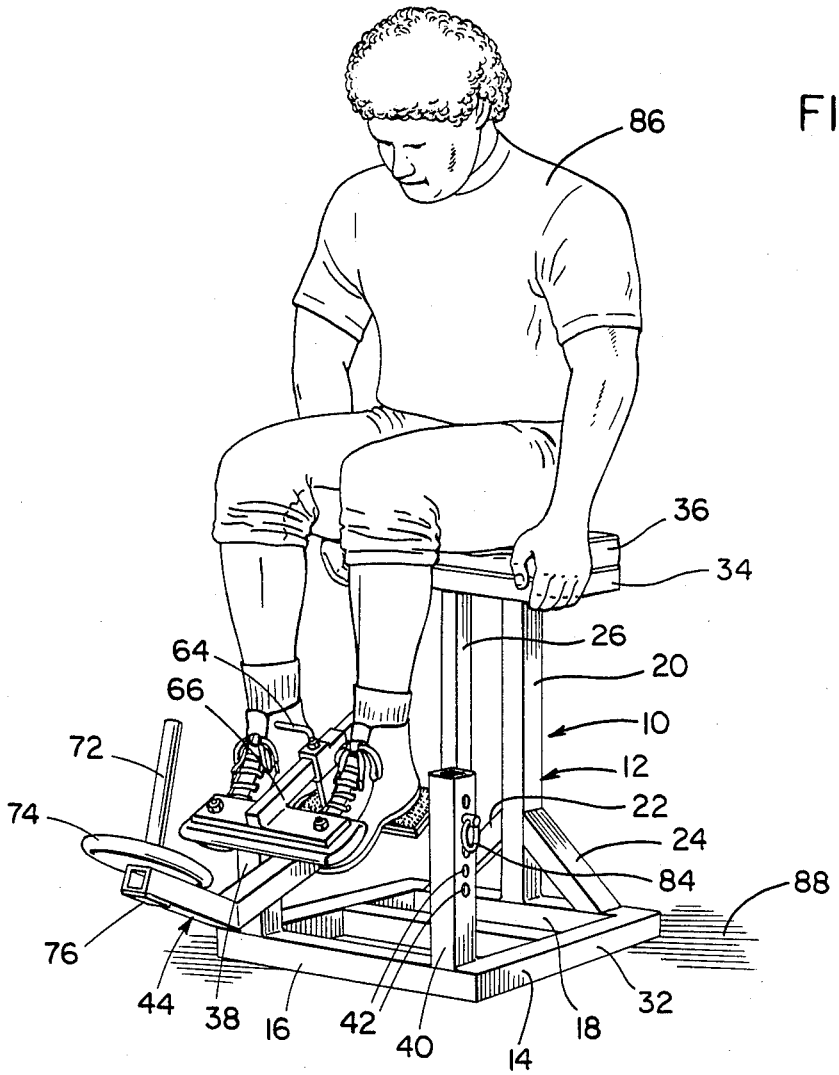
FIG. 1 is a perspective view of the exerciser with a person seated thereon and in the process of exercising his anterior lower leg muscles.
Figure 2:
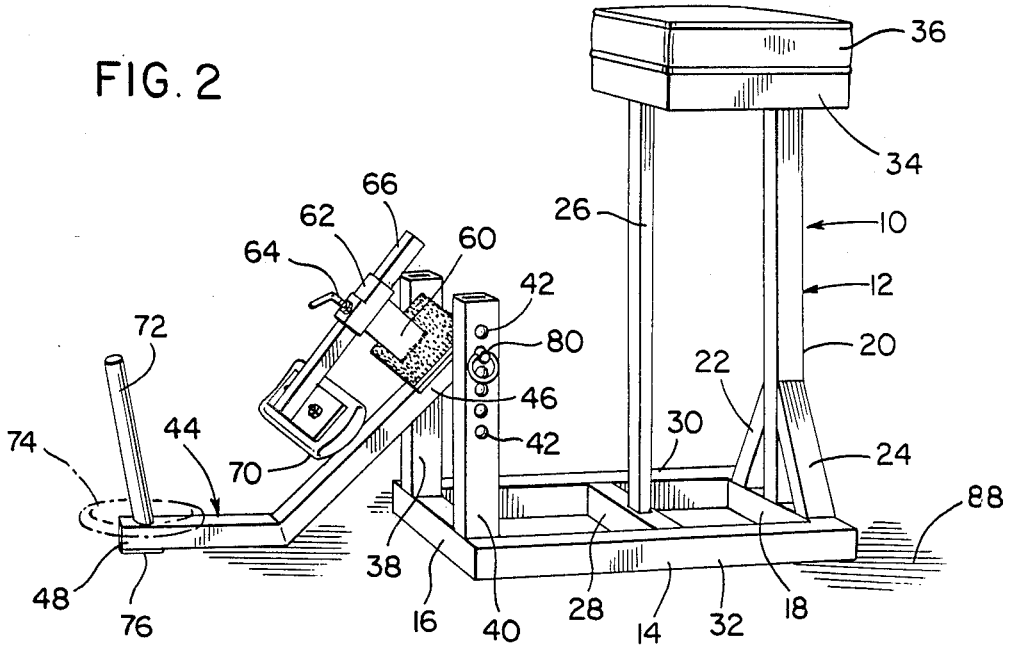
FIG. 2 is an enlarged perspective view of the exerciser.
Figure 3:
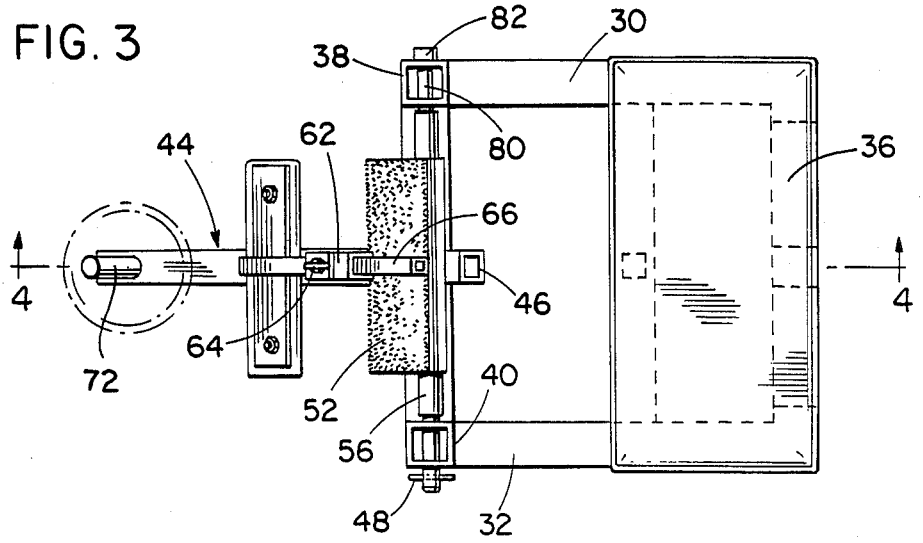
FIG. 3 is a top plan view of the exerciser.
Figure 4:
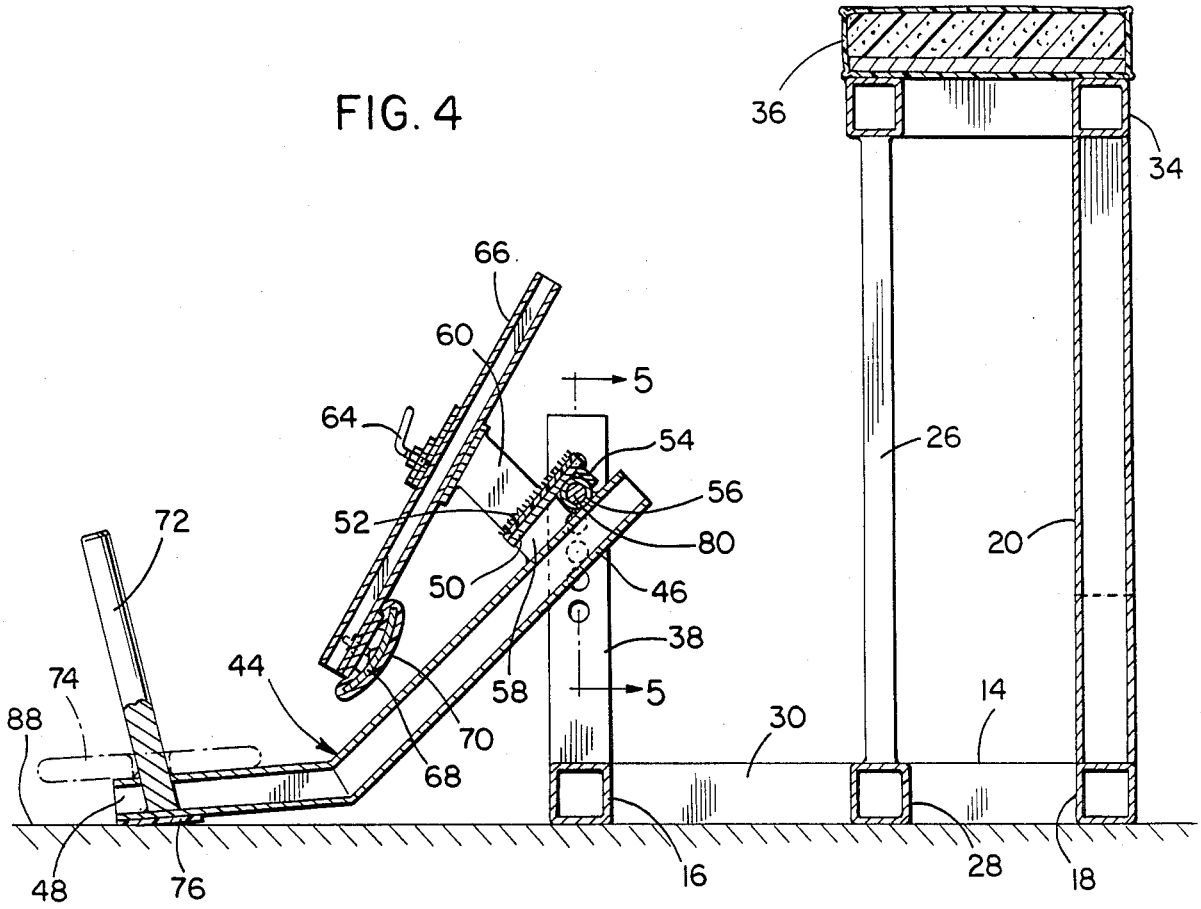
FIG. 4 is an enlarged longitudinal vertical sectional view taken substantially upon the plan indicated by the section line 4—4 of FIG. 3.
Figure 5:
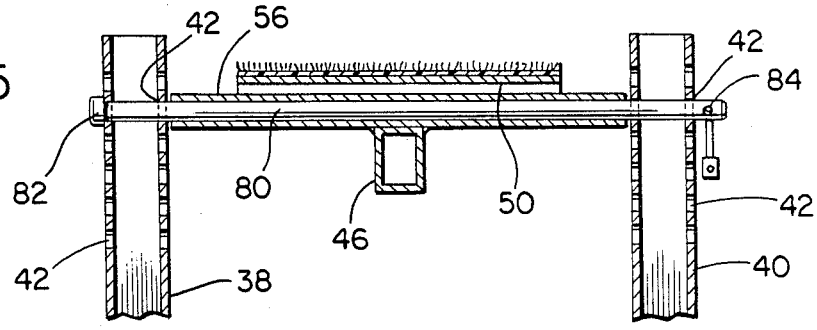
FIG. 5 is a fragmentary vertical sectional view taken substantially upon the plane indicated by the section line 5—5 of FIG. 4.

Referring now more specifically to the drawings, the numeral 10 generally designates the exerciser of the instant invention. The exerciser 10 includes an upright seat frame referred to in general by the reference numeral 12. The seat frame 12 includes a square tubular base 14 including front and rear marginal portions 16 and 18 and an upright seat standard 20 projecting upward from the longitudinal mid-portion of the rear marginal portion 18, the lower end of the seat standard 20 being braced by opposite side inclined tubular braces 22 and 24. In addition to the seat standard 20, the seat frame 12 includes a forward post 26 whose lower end is supported from the longitudinal portion of an elongated transverse brace member 28 secured and extending between opposite side marginal portions 30 and 32 of the base 14 extending and secured between corresponding opposite ends of the front and rear marginal portions 16 and 18. The upper end of the standard 20 and post 26 support the front and rear marginal portions of an upper horizontal rectangular frame 34 defining the upper end of the seat frame 12 and having a rectangular seat cushion 36 supported therefrom.

The opposite ends of the front marginal portion 16 of the frame 12 include a pair of upstanding tubular supports 38 and 40 supported therefrom and the tubular supports 38 and 40 include sets of vertically spaced aligned horizontal bores 42 formed therethrough.

An elongated weight arm referred to in general by the reference numeral 44 is provided and includes a rear upper end portion 46 and a forward lower end portion 48. In addition, the rear upper end portion 46 includes a transverse inclined abutment flange 50 having an upwardly facing surface covered by a pad 52. The upper rear marginal portion of the inclined flange 50 includes a right angle depending flange 54 supported therefrom and a horizontal transverse pipe 56 is secured in the corner defined between the underside of the abutment flange 50 and the right angle flange 54, the pipe 56 also being secured to the upper surface of the rear of the upper end portion 46 of the weight arm 44. The abutment flange 50 is carried by an upstanding plate 58 projecting upwardly from the upper surface of the rear upper end portion 46 of the weight arm 44 forward of the pipe 56 and the transverse mid-portion of the abutment flange 50 supports a second upwardly projecting plate 60 therefrom including a support sleeve 62 mounted from its upper end. The sleeve 62 is square in cross-section and supports a set screw 64 therethrough. In addition, a longitudinal mid-portion of a support arm 66 is slidably received through the sleeve 62 and secured in position therein through utilization of the set screw 64. The support arm 66 is forwardly and downwardly inclined and includes a transverse downwardly projecting abutment plate 68 supported from its lower end, the underside of the abutment plate 68 being padded as at 70.

The forward lower end portion 48 of the weight arm 44 includes an upstanding post 72 upon which an annular weight 74 may be disposed and the underside of the forward end portion of the weight arm 44 includes a cushion pad 76.

A pivot shaft 80 is passed through the pipe 56 and selected pairs of bores 42 in order to pivotally mount the weight arm 44 from the upright tubular supports or standards 38 and 40. One end of the shaft 80 includes an enlarged head 82 thereon and the other end removably receives a pin 84 therethrough in order to maintain the pivot shaft 80 in adjusted position.

In operation, a user 86 assumes a seated position on the seat cushion 36 in a forward facing position and with his upper leg portions substantially horizontally disposed and his lower leg portions substantially vertically disposed. The heel portions of the user's feet rest upon the abutment flange 50 and the toe portions of his feet are received beneath the abutment plate 68. Then, with the forward lower end portion 48 of the weight arm 44 resting upon the surface 86 which supports the base 14, the user 86 lifts the forward ends of his feet in order to upwardly swing the forward lower end portion 48 of the arm 44. The amount of weight represented by the weight member 74 determines the amount of effort required to upwardly swing the forward lower end portion 48 of the weight arm 44 from its position resting upon the surface 88. Repetitions of this exercise are carried out, as desired.

The pivot shaft 80 may be adjusted in height relative to the tubular supports 38 and 40 according to the length of the lower leg portions of the user 86 and the support arm 66 may be adjusted longitudinally of the sleeve 62 according to the length of the feet of the user 86.

The plates 58 and 64 are disposed, substantially, in a vertical plane containing the weight arm 44 and the user's feet are disposed on opposite sides of the plate 60.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A leg anterior muscle exerciser including a horizontal, generally rectangular base frame including front and rear transverse portions, an upright seat frame supported and projecting upwardly from said rear transverse portion and defining an upwardly facing seat having front and rear sides, a pair of upstanding supports stationarily mounted from opposite end portions of said front transverse portion and disposed forward of a vertical transverse plane containing the front side of said seat, an elongated front-to-rear extending weight arm including a rear rearwardly and upwardly inclined rear end portion and a lower generally horizontal forward end portion, pivot means, said pivot means and said supports including coacting means mounting said upper rear end portion of said arm between said supports for oscillation relative thereto about a horizontal axis disposed transverse to said arm and generally paralleling said plane, said upper rear end portion of said arm including elongated, transversely extending and rearwardly and upwardly inclined upwardly facing heel sole portion support surface means for engagement by the foot heel sole portions of a forwardly facing person disposed on said seat and having his upper leg portions generally horizontally disposed and his lower leg portions generally vertically disposed, a front-to-rear extending and upwardly projecting plate mounted from said surface means centrally intermediate the opposite ends thereof and disposed in a second vertical plane disposed normal to the first mentioned plane, a rearwardly and upwardly inclined sleeve mounted from an upper portion of said plate, an elongated rearwardly and upwardly inclined support arm spaced above the upper rear end portion of said weight arm, said support arm being slidably received through said sleeve for longitudinal shifting relative thereto, said sleeve and support arm including means operative to releasably secure said support arm in adjusted shifted position relative to said sleeve, the lower end of said support arm including horizontally elongated and transverse downwardly facing rearwardly and upwardly inclined surface means spaced forward of said upwardly facing support surface means and beneath which the upward forward portions of said person's feet disposed on opposite sides of said second vertical plane may be engaged, the forward end portion of said weight arm including support means for supporting various weight value weight members therefrom.

2. The exerciser of claim 1 wherein said coacting means includes adjustment means operative to adjustably vary the elevation of said axis along said supports.

3. The exerciser of claim 1 wherein said base frame includes a central transverse brace member spaced between said front and rear transverse portions, and an upright post extending between said transverse brace member and a forward portion of said seat.

4. The exerciser of claim 3 wherein said base frame includes front-to-rear extending opposite side marginal portions interconnecting corresponding ends of said transverse brace member and said front and rear transverse portions.

* * * * *